US005451985A

United States Patent [19]

Cho

[11] Patent Number: 5,451,985

[45] Date of Patent: Sep. 19, 1995

[54] AREA GRADATION CONTROL DEVICE AND METHOD FOR A THERMAL PRINTER

[75] Inventor: Weon S. Cho, Kyunggi-do, Rep. of Korea

[73] Assignee: Goldstar Co., Ltd., Seoul, Rep. of Korea

[21] Appl. No.: 58,935

[22] Filed: May 6, 1993

[30] Foreign Application Priority Data

May 7, 1992 [KR] Rep. of Korea ..... 1992-7721

[51] Int. Cl.[6] ..... B41J 2/36

[52] U.S. Cl. ..... 347/183; 358/298; 347/209

[58] Field of Search ..... 346/76 PH; 358/298

[56] References Cited

U.S. PATENT DOCUMENTS

| | | | |
|---|---|---|---|
| 4,621,271 | 11/1986 | Brownstein | 346/76 PH |
| 4,745,413 | 5/1988 | Brownstein et al. | 346/76 PH |
| 4,806,949 | 2/1989 | Onuma et al. | 346/76 PH |
| 4,899,170 | 2/1990 | Izumi | 346/76 PH |

FOREIGN PATENT DOCUMENTS 0084671 4/1987 Japan .

OTHER PUBLICATIONS

M. D. Fiscella et al., "Pulse count modulation: a novel head drive method for thermal printing," Photographic Research Laboratory, Eastman Kodak Company, Rochester, New York 14650-01824 (1990).

*Primary Examiner*—Huan H. Tran

*Attorney, Agent, or Firm*—Christie, Parker & Hale

[57] ABSTRACT

An area gradation control device and method for a thermal printing thermosensitive recorder, such as a color video printer or a facsimile, performs a printing operation by converting color-corrected and gamma-corrected data into area gradation signals. One bit among 8-bit data is sequentially selected according to gradations and transmitted to a thermal printing head, and strobe pulses whose number corresponds to the weight value of each bit are provided to the thermal printing head for each time a selected significant bit is provided to the thermal printing head, so that dye deposition is uniformly performed over the overall area of a pixel with a high data processing speed.

2 Claims, 4 Drawing Sheets

*1 PIXEL, 256 GRADATION
(WHEN DATA=170)

* 1 PIXEL, 256 GRADATION
(WHEN DATA = 170)

AREA GRADATION CONTROL DEVICE AND METHOD FOR A THERMAL PRINTER

BACKGROUND OF THE INVENTION

1. Field of the invention

The present invention relates to a device and method for controlling area gradation for a thermal printer, and more particularly to an area gradation control device and method which enables high speed printing with high quality.

The thermal printer is a device for printing data of one screen using a thermal printing head, and can be a color video printer, a facsimile, etc.

Generally, as shown in FIG. 1, a thermal printer comprises a frame memory 2 for storing video signal data one-frame by one-frame and providing R-(red), G-(green), and B-(blue) color signals under the control of a frame memory controller 1, a color corrector 3 for correcting the R, G, and B color signals provided from the frame memory 2 to Y (yellow), M (magenta), and C (cyan) color signals, a gamma corrector 4 for gamma-correcting the Y, M and C color signals provided from the color corrector 3, a line memory 6 for storing and providing the gamma-corrected video signal data one-line by one-line under the control of a line memory controller 5, and an area gradation controller 7 for area-grading the video signal data provided from the line memory 6 and transmitting the area-graded video signal data to a thermal printing head 8.

The area gradation controller is a circuit for controlling area gradation of video signal data by one line (480 pixels), and transmission of strobe pulses, latch signals, clock pulses, etc., to the thermal printing head. As shown in FIG. 2, a conventional area gradation controller 7 comprises data counter 71 for counting the number of data, control signal generator 72 for providing strobe pulses (STROBE), latch signals (LATCH), and clock pulses (CLOCK) to thermal printing head 8, gradation counter 73 for counting the number of gradations, data latch 74 for dividing input data into odd and even data, and gradation comparator 75 for comparing gradations of odd and even data according to gradation data provided from gradation counter 73 and providing compared data to thermal printing head 8.

With reference to FIGS. 2 and 3, pixel data (480 pixels$\times$8 bits) provided from line memory 6 are divided into odd and even bits, which are respectively stored in data latch 74. Then, gradation comparator 75 compares odd data D1 and even data D2 with current gradation data (data supplied from the gradation counter 73). As a result of comparison, if the data value is greater than a gradation value, "high" ("1") level data is transmitted to thermal printing head 8, and if not, "low" ("0") level data is transmitted. The above operation is repeatedly performed for every data of 480 pixels, 256 gradations. When transmission of 480 pixel data is completed, data outputted from gradation comparator 75 is latched in thermal printing head 8 by latch signal LATCH outputted from control signal generator 72 and a strobe pulse STROBE is supplied with a low level input, and accordingly, thermal printing head 8 generates heat. At the same time, the above operation is repeated until the 256th ($=2^8$) gradation by increasing the gradation by 1, thereby completing data print of one line.

FIG. 4 shows an example of data printed by the above-conventional device, and shows a form of printed one-pixel, in case of having 170 data in one pixel of 256 gradations. A one-pixel is divided into 256 sections and the sections (shaded portion) corresponding to gradations of the respective data (=170) are printed.

However, such a conventional area gradation device has a problem of having difficulty in fidelity-reproduction of original colors and deterioration of picture quality, because only a partial portion corresponding to gradations of data from the front of the pixel, not over the overall one-pixel, is printed. Also, in the area gradation method having 256 gradations, a current gradation is compared by being increased from the 1st to 256th gradation, and the compared data is repeatedly read out 256 times and then is transmitted to the thermal printing head, thereby decreasing the printing speed.

Meanwhile, Japanese Patent Laid-open No. Sho 62-84671 discloses a color printer which can provide a stable temperature correction of the joint of respective divided blocks when a two-block divided thermal printing head prints. This color printer comprises an image memory and a line memory for storing a video signal, a thermal printing head divided into two blocks or more, control means for providing a video signal supplied from the line memory to the respective blocks of the thermal printing head, and processing means for correcting data near the border of the block according to a temperature detected by a temperature sensor positioned near the border of the block of the thermal printing head, thereby printing on-line data with time-sharing two times or more.

However, in transmission of one-line data to the thermal printing head by the control means, data corresponding to the number of gradations is transmitted as in the aforementioned conventional area gradation control device. Therefore, such a conventional color printer cannot solve the problems of poor fidelity-reproduction and deterioration of printing speed.

SUMMARY OF THE INVENTION

It is an object of the present invention to provide an area gradation control device and method for a thermal printer, which can print over the overall pixel according to a transmitted data value and faithfully reproduce original colors.

It is another object of the present invention to provide an area gradation control device and method for a thermal printer which can transmit data corresponding to the number of bits according to the gradations, and can print at high speed with high data processing speed by changing the number of strobe pulses according to the weight value of each data bit.

In one embodiment, the present invention provides an area gradation control device for a thermal printer having a thermal printing head, which comprises:

a data latch for dividing one-line pixel data into odd and even data and temporarily storing the divided odd and even data;

a multiplexer for providing the divided odd and even data to the thermal printing head bit by bit;

a bit selection controller for providing a bit selection signal to the multiplexer, thereby making the multiplexer select one bit of the data according to the bit selection signal;

a gradation counter for increasing a current gradation and providing an increased gradation to the bit selection controller; and a control signal generator for providing a clock signal to the gradation counter, and providing strobe pulses whose number corresponds to a bit selected by the multiplexer, a latch signal and a clock signal to the thermal printing head.

In another embodiment, the present invention also provides an area gradation control method for a thermal printer having a thermal printing head, which comprises the steps of:

a) dividing one-line pixel data into odd and even pixel data;

b) sequentially selecting and providing to the thermal printing head each significant bit with respect to all of the divided odd and even pixel data by sequentially decreasing the weight value of the significant bit by one bit from the most significant bit to the least significant bit; and c) generating strobe pulses and providing such pulses to the thermal printing head, the number corresponding to the weight value of the selected significant bit, the pulses being provided at each moment following the provision of each selected significant bit to the thermal printing head is completed during the significant-bit-selecting and -providing step.

BRIEF DESCRIPTION OF THE DRAWINGS

The above illustrative objectives and other advantages of the present invention will become more apparent by describing the preferred embodiment of the present invention with reference to the attached drawings, in which.

DETAILED DESCRIPTION OF THE PREFERRED EMBODIMENT

Figure 5:
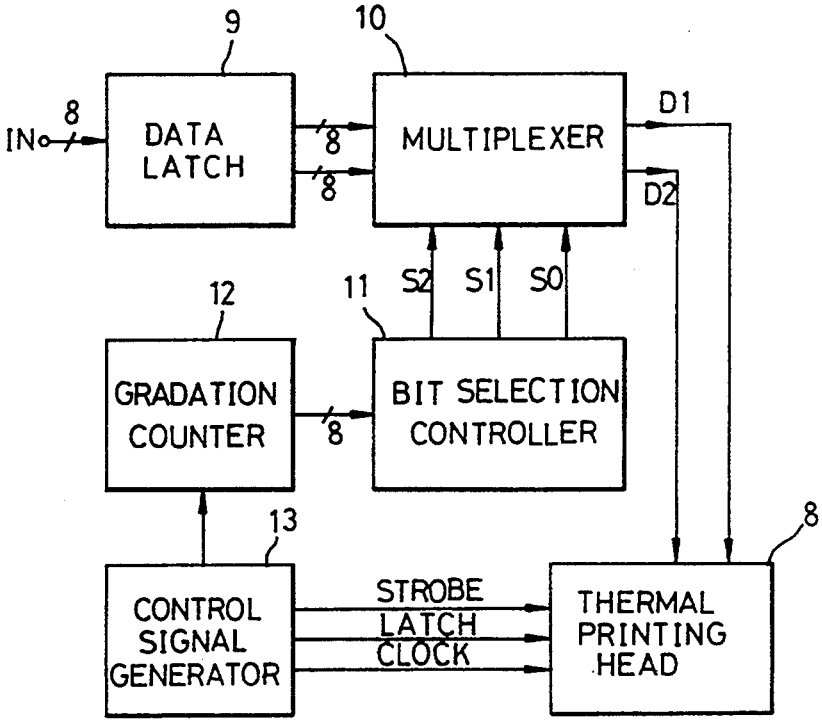
FIG. 5 is a block diagram of an area gradation control device according to the present invention.

With reference to FIG. 5, the area gradation control device of the present invention comprises a data latch 9 for dividing pixel data from a line memory into odd and even data and temporarily storing the divided odd and even data, a multiplexer 10 for respectively outputting the divided odd and even data to thermal printing head 8 bit by bit, and a bit selection controller 11 for supplying a bit selection signal S0 to S2 to multiplexer 10, thereby making multiplexer 10 select and output one bit of the data according to the bit selection signal. Also, the present device is provided with a gradation counter 12 for increasing a current gradation and supplying the increased gradation to bit selection controller 11, and a control signal generator 13 for supplying a clock signal to gradation counter 12, and supplying strobe pulses whose number corresponds to the bit selected by multiplexer 10, a latch signal and a clock signal to thermal printing head 8.

Figure 6:
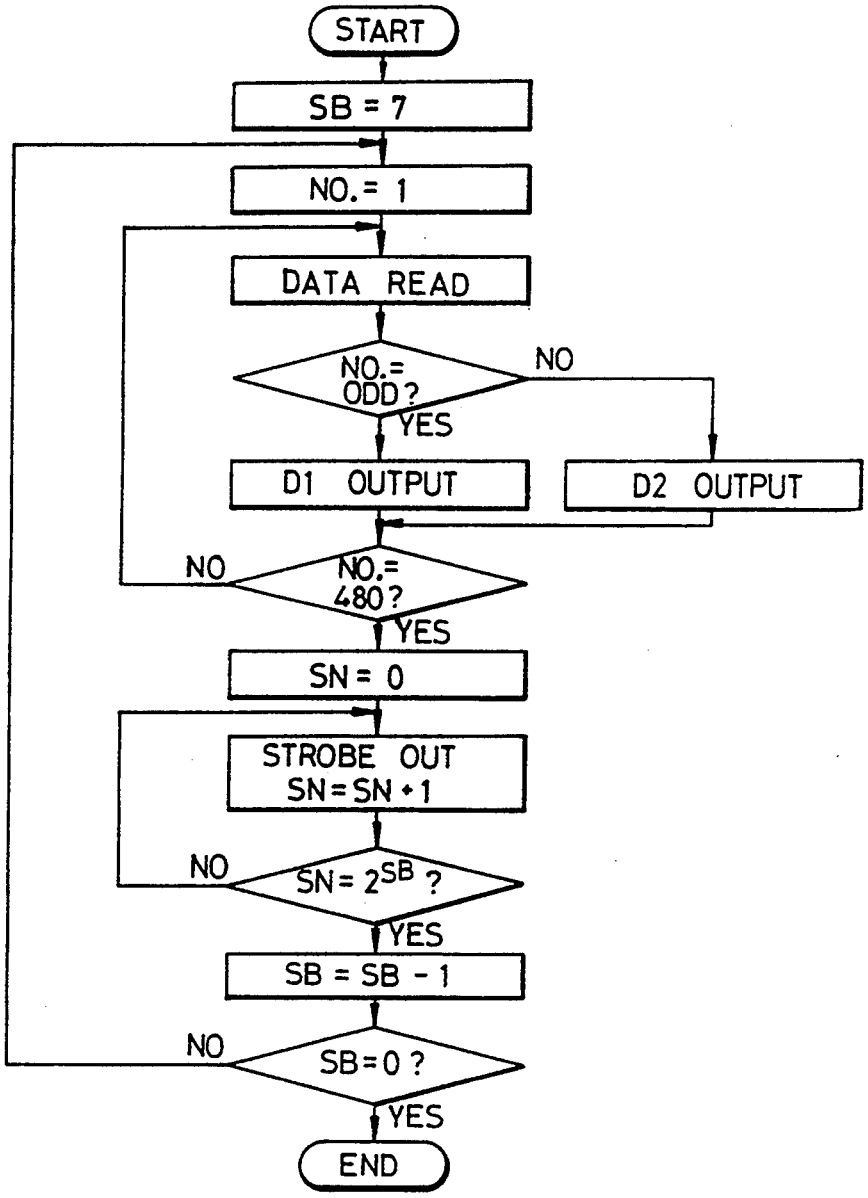
FIG. 6 is an algorithm diagram where the present area gradation control method is applied.

Hereinafter, an area gradation control device and method according to the present invention will be described in detail with reference to FIGS. 5 and 6.

First of all, a number SB is set to be a most significant bit (MSB) value, i e., "7." Then, color-corrected and gamma-corrected data stored in the line memory are read out and stored in data latch 9, being divided into odd and even data D1 and D2. Multiplexer 10 selects only MSBs, i.e., 7th bits, of data D1 and D2 outputted from data latch 9 under the control of bit selection controller 11 and transmits the selected bits to thermal printing head 8.

At this time, gradation counter 12 counts the clock signal outputted from control signal generator 13 and supplies the counted current gradation data to bit selection controller 11. Bit selection controller 11 supplies the bit selection signal S0, S1 and S2 obtained by decoding the inputted gradation data, to multiplexer 10, which selects MSBs of inputted data D1 and D2 and ouputs the selected MSBs to thermal printing head 8. Data transmission is completed by performing the sequential operations for data corresponding to 480 pixels in one line.

When data transmission is complete, control signal generator 13 supplies 128 strobe pulses STROBE to thermal printing head 8 by increasing by one the strobe pulse number SN from 0 to $2^{SB}$, where in this case, the bit weight value of SB=7, this is, $SN=2^{SB}=2^7=128$. When the supply of strobe pulses for MSB is completed, SB is decreased by one bit. Then, for the next bit ($SB-1=7-1=6$; 6th bit), the supply of $2^6=64$ strobe pulses are performed by bit selection controller 11 and multiplexer 10 in the same way.

While these operations are sequentially performed until the least significant bit (LSB) (0th bit), $2^{SB}$ strobe pulses are supplied by control signal generator 13 at each time. That is, as data is transmitted one-bit by one-bit, strobe pulses ($2^{SB}$) whose number corresponds to the bit weight value of each bit are generated, thereby performing one-line print operation.

Figure 7:
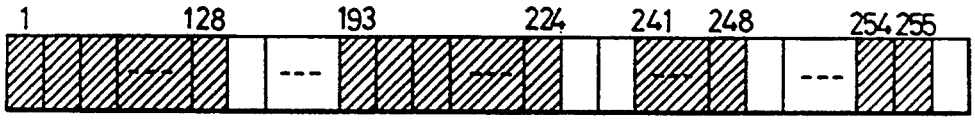
FIG. 7 shows an example of one pixel printed by the present area gradation control device.

FIG. 7 shows a printed form of one pixel, having 170 data in one pixel of 256 gradations. As shown in FIG. 7, the thermosensitive recording (shaded portion) is performed over the overall 256 gradations.

Figure 1:
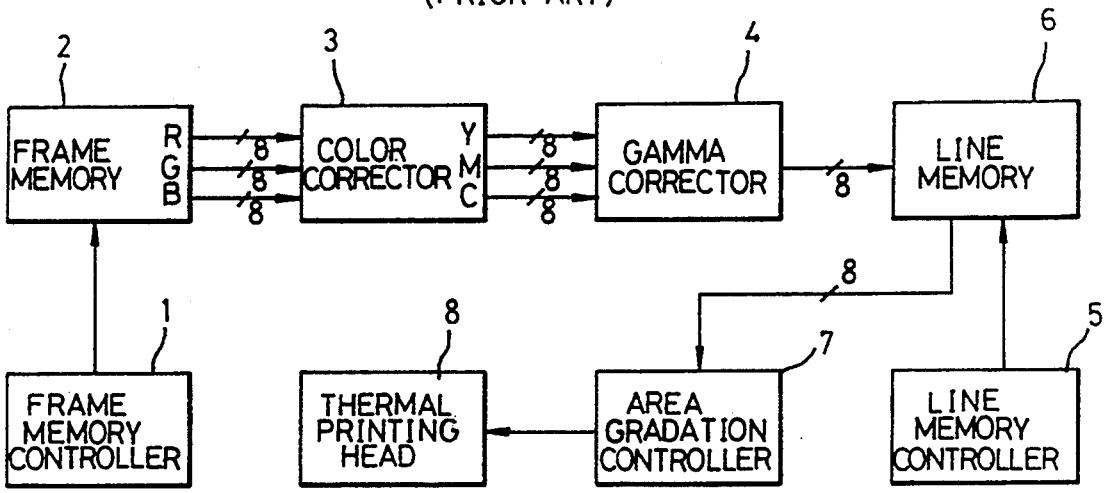
FIG. 1 (PRIOR ART)
FIG. 1 is an overall block diagram of a general thermal printer.
Figure 2:
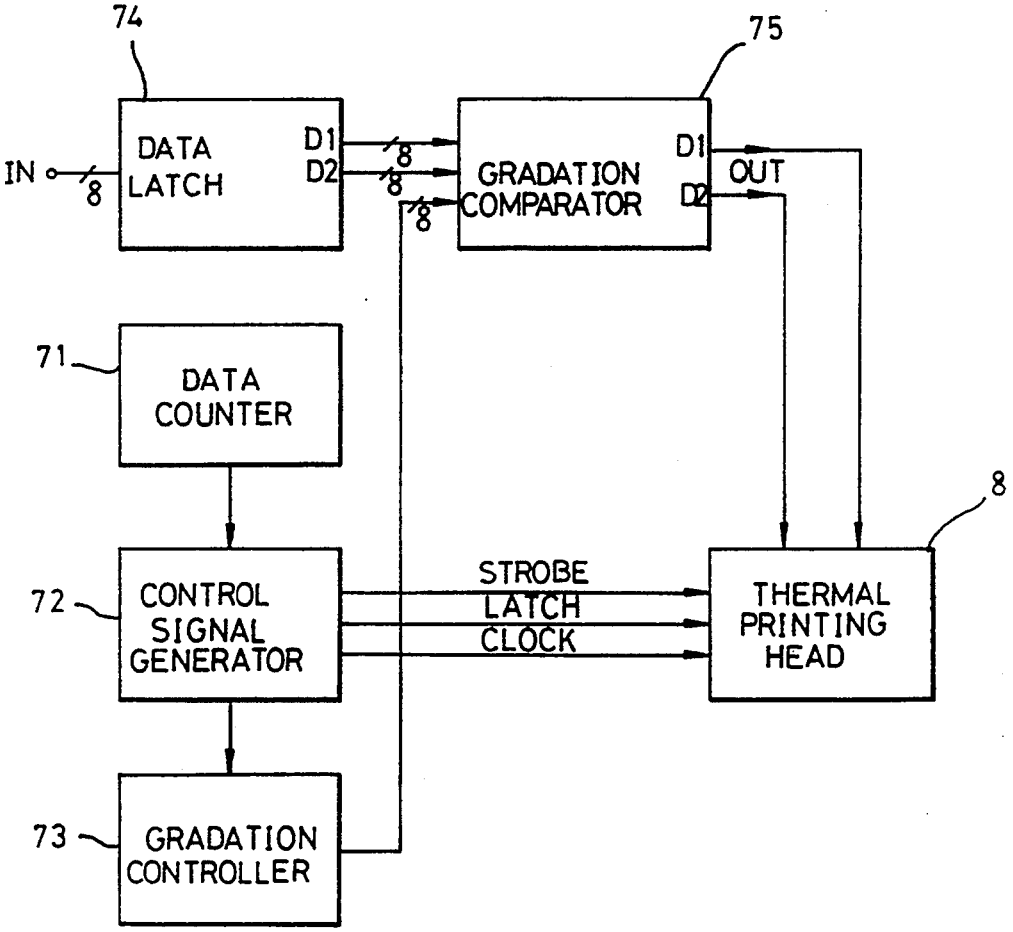
FIG. 2 (PRIOR ART)
FIG. 2 is a block diagram of a conventional area gradation control device.
Figure 3:
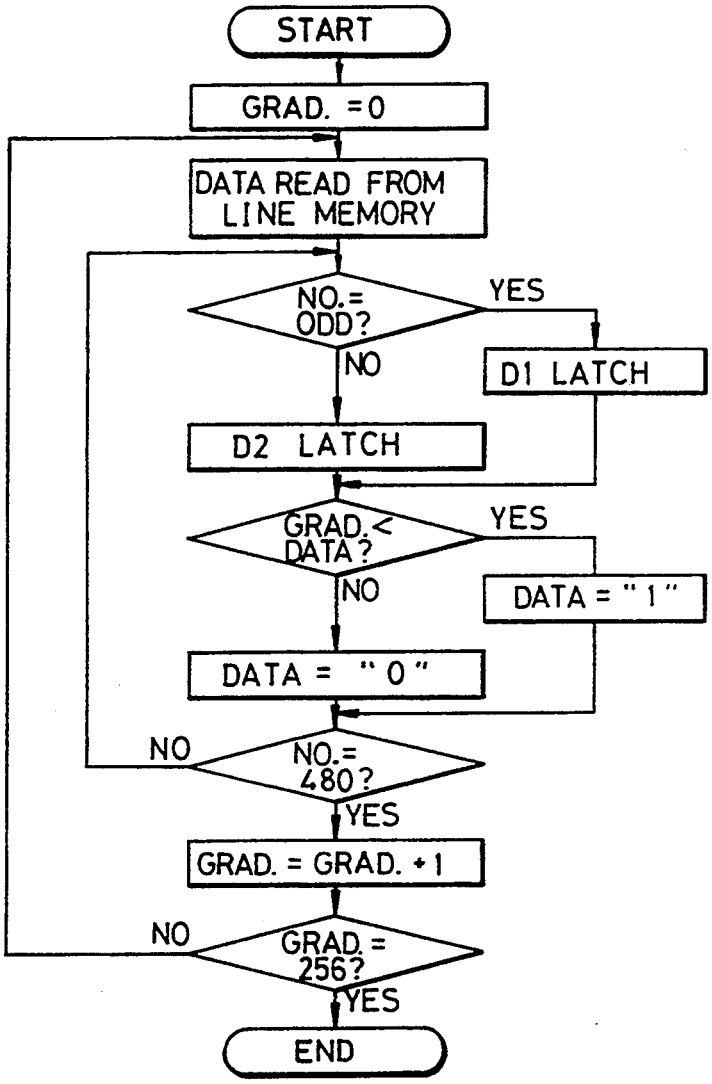
FIG. 3 (PRIOR ART)
FIG. 3 is an algorithm diagram where a conventional area gradation control method is applied.
Figure 4:
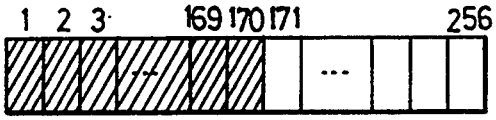
FIG. 4 (PRIOR ART)
FIG. 4 shows an example illustrating the construction of one pixel printed by a conventional area gradation control device.

The conventional method of FIG. 4 has a nonuniform distribution within a one-pixel area because dye is deposited on only the front portion of printing paper according to data value. By contrast, according to the present invention, even if the same amount of dye is deposited, it is uniformly distributed over the overall printing paper and thus achieves high fidelity color reproduction which is smooth and close to the original color. Also, instead of transmission of data corresponding to the number of gradations to the thermal printing head, in the present invention, transmission of data in the unit of a bit is performed. Accordingly, when 8-bit data, 256 gradations are printed, the printing is performed only by the 8 times data reading and the supply of strobe pulses, with the number of pulses corresponding to each bit of 8-bit data, so that the printing can be done at high speed.

While the present invention has been described and illustrated herein with reference to the preferred embodiment thereof, it will be understood by those skilled in the art that various changes in form and details may be made therein without departing from the spirit and scope of the invention.

What is claimed is:

1. An area gradation control device for a thermal printer having a thermal printing head, comprising:

a data latch for dividing one-line pixel data into odd and even data and temporarily storing said divided odd and even data;

a multiplexer for providing said divided odd and even data to said thermal printing head bit by bit;

a bit selection controller for providing a bit selection signal to said multiplexer, thereby making said multiplexer select one bit of said divided odd and even data according to said bit selection signal;

a gradation counter for increasing a current gradation and providing an increased gradation to said bit selection controller; and a control signal generator for providing a clock signal to said gradation counter, and providing strobe pulses whose number corresponds to a bit selected by said multiplexer, a latch signal and a clock signal to said thermal printing head.

2. An area gradation control method for a thermal printer having a thermal printing head, comprising the steps of:

a) dividing one-line pixel data into odd and even pixel data;

b) sequentially providing to the thermal printing head each significant bit with respect to all of the divided odd and even pixel data by sequentially selecting the significant bit by one bit from a most significant bit to a least significant bit; and c) generating and providing to the thermal printing head strobe pulses whose number corresponds to a weight value of the selected significant bit at each moment when providing each of the selected significant bit to the thermal printing head is completed during the significant-bit-selecting and -providing step.

* * * * *

UNITED STATES PATENT AND TRADEMARK OFFICE

CERTIFICATE OF CORRECTION

PATENT NO. : 5,451,985

DATED : September 19, 1995

INVENTOR(S) : Weon S. Cho

It is certified that error appears in the above-indentified patent and that said Letters Patent is hereby corrected as shown below:

Column 1, lines 17-18, change "R-(red), G-(green), and B-(blue)" to -- R (red), G (green), and B (blue) --.

Column 4, line 25, after "SB=7," change "this" to -- that --.

Column 6, line 15, after "head" insert "which".

Signed and Sealed this

Thirtieth Day of April, 1996

Bruce Lehman

*Attest:*

BRUCE LEHMAN

*Attesting Officer*

*Commissioner of Patents and Trademarks*